US005641310A

United States Patent [19]

Tiberio, Jr.

[11] Patent Number: 5,641,310

[45] Date of Patent: Jun. 24, 1997

[54] LOCKING TYPE ELECTRICAL CONNECTOR WITH RETENTION FEATURE

[75] Inventor: Patrick J. Tiberio, Jr., Huntington, Conn.

[73] Assignee: Hubbell Incorporated, Orange, Conn.

[21] Appl. No.: 354,738

[22] Filed: Dec. 8, 1994

[51] Int. Cl.[6] ..... H01R 13/64

[52] U.S. Cl. ..... 439/680

[58] Field of Search ..... 439/680, 186, 439/113, 315, 314, 681, 677, 488, 489, 491

[56] References Cited

U.S. PATENT DOCUMENTS

| | | | |
|---|---|---|---|
| 1,818,290 | 8/1931 | Wulle | 200/50 B |
| 1,924,691 | 8/1933 | Lofgren | 200/50 B |
| 1,934,024 | 11/1933 | Anderson | 200/50 B |
| 1,971,990 | 8/1934 | Reynolds et al. | 200/50 B |
| 2,241,828 | 5/1941 | Reynolds | 200/50 B |
| 2,396,901 | 3/1946 | Tiffany | 439/140 |
| 2,397,595 | 4/1946 | Conlan | 200/50 B |
| 2,441,465 | 5/1948 | Bauroth | 200/50 B |
| 2,470,944 | 5/1949 | Parish | 200/50 B |
| 3,393,395 | 7/1968 | Hubbell | 339/91 |
| 3,513,436 | 5/1970 | Nodfelt | 339/90 |
| 3,551,880 | 12/1970 | Hartwell | 339/89 |
| 3,585,323 | 6/1971 | Appleton | 200/50 B |
| 3,735,078 | 5/1973 | Appleton et al. | 200/168 G |
| 3,784,961 | 1/1974 | Gartland | 439/465 |
| 3,945,702 | 3/1976 | Poliak et al. | 339/88 R |
| 3,982,804 | 9/1976 | Marechal | 339/41 |
| 4,056,298 | 11/1977 | Cooper et al. | 339/90 R |
| 4,213,667 | 7/1980 | Wittes | 439/469 |
| 4,503,293 | 3/1985 | Knecht | 200/50 B |
| 4,506,121 | 3/1985 | Peterson et al. | 200/50 B |
| 4,531,798 | 7/1985 | Baur et al. | 439/488 |
| 4,553,000 | 11/1985 | Appleton | 200/50 B |
| 4,604,505 | 8/1986 | Henninger | 200/50 B |
| 4,902,238 | 2/1990 | Iacobucci | 439/135 |
| 5,046,961 | 9/1991 | Hoffman | 439/141 |
| 5,108,297 | 4/1992 | Hoffman et al. | 439/134 |
| 5,298,701 | 3/1994 | Sandor | 200/50 B |

FOREIGN PATENT DOCUMENTS

| | | |
|---|---|---|
| 2342805 | 3/1975 | Germany . |
| 3513591 | 10/1986 | Germany . |

OTHER PUBLICATIONS

Hubbell Catalog, Wiring Devices & Systems, Kellems Wire Management Marine Wiring Products, 1995, Section B, B1–B54.

*Primary Examiner*—P. Austin Bradley
*Assistant Examiner*—Yong Ki Kim

[57] ABSTRACT

A first rotatable locking type electrical connector having a polarizing sleeve with a detent and a first set of electrical contacts for electrically engaging a second rotatable locking type electrical connector having a complementary polarizing sleeve with a complementary detent and a second set of electrical contacts. In the preferred embodiments, the polarizing sleeve of the first electrical connectors has at least one key, preferably two keys, while the polarizing sleeve on the second electrical connector has a complementary slot or slots for receiving the key or keys of the first electrical connector. Each of the slot of the second electrical connector is arranged to receive a key of the first electrical connector so that the first and second electrical connectors can be coupled together by initial axial movement and subsequent rotational movement. Preferably, the detents are formed on the keys and within the slots for holding the electrical connectors against unintentional movement. Preferably, one of the detents is formed by alignment indicia, which indicates when the key and slot of the electrical connectors are properly aligned for axial movement and subsequent rotational movement.

56 Claims, 10 Drawing Sheets

LOCKING TYPE ELECTRICAL CONNECTOR WITH RETENTION FEATURE

FIELD OF THE INVENTION

This invention relates to electrical connectors of the locking type, which are electrically coupled together by inserting the blade contacts of the male electrical connector into the apertures of the female electrical connector and then rotating the electrical connectors relative to each other. More specifically, this invention relates a positive locking arrangement for holding a pair of locking type electrical connectors in their electrically coupled position to avoid inadvertent disconnection therebetween.

BACKGROUND OF THE INVENTION

Electrical connector assemblies of the locking type are well known in the electrical connector industry, and are commonly used to prevent accidental separation between a plug or male electrical connector and a receptacle or female electrical connector. Normally, the female connector of such an electrical connector assembly has two or more arcuate, circularly arranged slots, while the male connector has an equal number of arcuate blades which are dimensioned and arranged for insertion into the slots of the female connector by a simple axial movement, and then, via a rotation of one or both of the electrical connectors, the blades can be moved into a position from which they cannot be separated by simple axial movement. To accomplish this, one or more of the blades usually has an L-shaped configuration in which the laterally extended portion, or flag, of the blade engages a recess or shelf within the slot of the female portion as a result of the rotation.

The male and female connectors can take various configurations, but the male connector is usually a plug connected to the end of a multi-conductor cable. The female connector may also terminate a similar cable, or it can be a fixture or receptacle mounted in a partition or on a piece of equipment. In any event, it is possible for the cable attached to the male connector and/or female connector to be subjected to various forces which might tend to rotate the cable and also the male connector and/or female connector in the unlocking direction, thereby causing inadvertent unlocking and extraction of the blades from the slots.

To prevent this kind of undesired extraction, there has been an effort to develop connectors which have greater resistance to accidental disconnection or which have locking devices capable of precluding such accidental disconnection. However, many of these prior art devices are complicated to manufacture, assemble and use, and many of them require a significant number of parts and a specially designed female device to cooperate with the male device.

Examples of various rotatable locking type electrical connectors are disclosed in the following U.S. Pat. Nos.: 2,396,901 to Tiffany; 3,393,395 to Hubbell; 3,784,961 to Gartland; 3,945,702 to Poliak et al; 4,213,667 to Wittes; 5,046,961 to Hoffman; and 5,108,297 to Hoffman et al.

Examples of other non-rotatable electrical connectors with various locking arrangements to prevent inadvertent uncoupling of mating electrical connectors are disclosed in the following U.S. Pat. Nos.: 2,241,828 to Reynolds; 3,513,436 to Nodfelt; 3,551,880 to Hartwell; 3,585,323 to Appleton et al; 3,735,078 to Appleton et al; 4,056,298 to Cooper et al; 4,506,121 to Peterson et al; 4,553,000 to Appleton; 4,604,505 to Henninger; 4,902,238 to Iacobucci; and 5,298,701 to Sandor.

In view of the above, it is apparent that there exists a need for mating electrical connectors of the locking type with a locking arrangement to prevent inadvertent uncoupling between the mating electrical connectors. This addresses this need in the art, along with other needs which will become apparent to those skilled in the art once given this disclosure.

SUMMARY OF THE INVENTION

One object of the present invention is to provide a locking arrangement to positively lock a pair of mating locking type electrical connectors together.

Another object of the present invention is to provide locking type electrical connectors with a retention feature that is relatively simple to manufacture, assemble and use.

Another object of the present invention is to provide locking type electrical connectors with a retention feature that has relatively few parts and inexpensive to manufacture.

Another object of the present invention is to provide electrical connectors with a retention feature that use most of the parts of prior art electrical connectors.

The foregoing objects are basically attained by providing a rotatable locking type electrical connector, comprising: an insulated housing with a sleeve extending therefrom for nesting with a portion of a mating locking type electrical connector; a set of electrical contacts coupled to the housing for electrically engaging electrical contacts of the mating locking type electrical connector; a first polarizing member positioned on the sleeve for coupling only with a mating locking type electrical connector having a complementary rotatable polarizing member; and a locking detent positioned on the sleeve in a position to engage a complementary detent of the mating locking type electrical connector after relative axial insertion and subsequent rotation of the housing with the mating locking type electrical connector for holding the housing, the set of electrical contacts and the polarizing member from relative rotational movement with the mating locking type electrical connector, the locking detent being overridably engageable with the complementary detent by applying an intentional, manual release rotation between the housing and the mating locking type electrical connector.

The foregoing objects are also attained by providing a rotatable locking type electrical connector assembly, comprising: a first rotatable locking type electrical connector including a first insulated housing, a first set of electrical contacts coupled to the first housing, a first rotatable polarizing sleeve extending from the first housing, and a first detent positioned on the first polarizing sleeve; and a second rotatable locking type electrical connector releasably engageable with the first electrical connector, the second electrical connector including a second insulating housing, a second set of electrical contacts coupled to the second housing for electrically engaging the first set of electrical contacts upon relative insertion and rotation therebetween, a second rotatable polarizing sleeve extending from the second housing for rotatably mating with the first polarizing sleeve after relative axial movement therebetween, and a second detent positioned on the second polarizing sleeve for engaging the first detent of the first electrical connector after relative axial insertion and relative rotational movement occurs between the first and second polarizing sleeves to hold the first and second polarizing sleeves in a coupled position, the first and second detents being configured to be overridable by applying an intentional, manual release rotation between the first and second housings.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

Referring initially to FIGS. 1–5, an electrical connector assembly 10 in accordance with the present invention is illustrated, and includes a male electrical connector or plug 12 and a receptacle or female electrical connector 14. Male and female electrical connectors 12 and 14 are rotatable locking type electrical connectors which are electrically coupled together by initial axial movement and subsequent rotational movement therebetween. Electrical connectors 12 and 14 are also provided with a locking arrangement for holding electrical connectors 12 and 14 in their electrically coupled position to avoid inadvertent disconnection therebetween as discussed below.

Electrical connectors 12 and 14 are polarized, as discussed below, to ensure the correct orientation therebetween so that electrical connectors 12 and 14 can only be mated at a given and predetermined axial orientation relative to each other. This ensures that the same male contacts always engage the same female contacts and that only particular types of connectors can be mated together.

Figure 1:
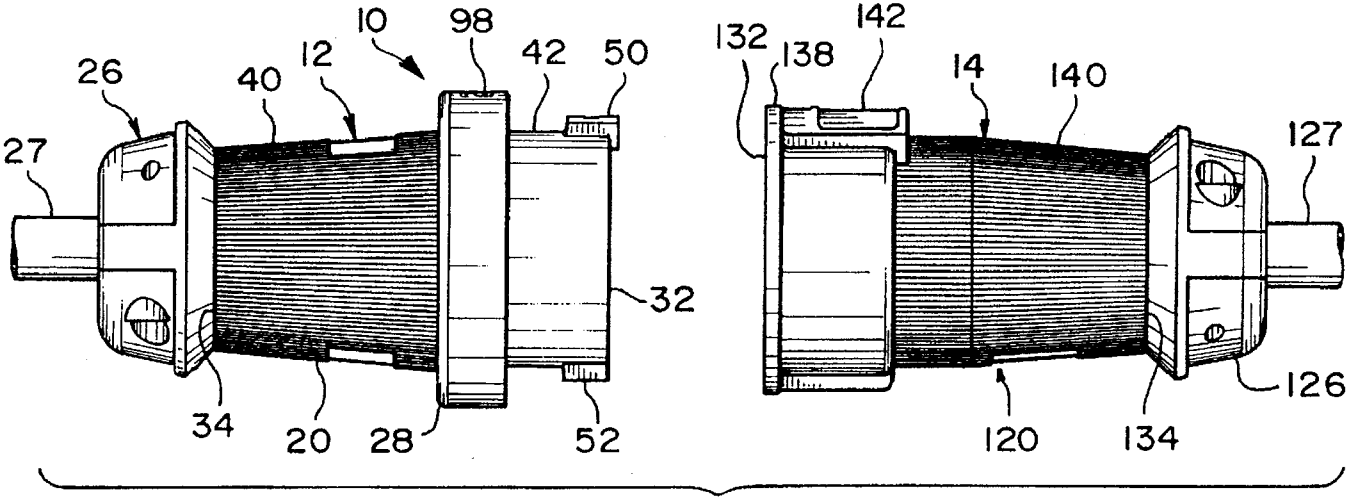
FIG. 1 is a side elevational view of an electrical connector assembly including a receptacle or female electrical connector and a plug or male electrical connector in accordance with the present invention, just prior to coupling therebetween.
Figure 2:
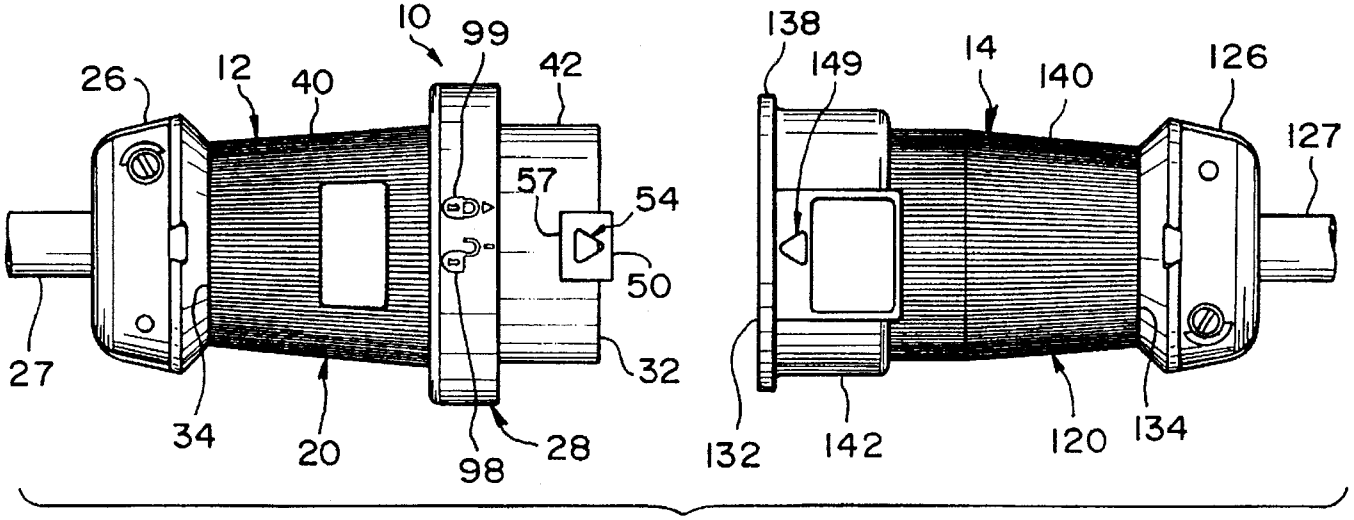
FIG. 2 is a top plan view of the electrical connector assembly illustrated in FIG. 1 just prior to coupling of the electrical connectors.
Figure 3:
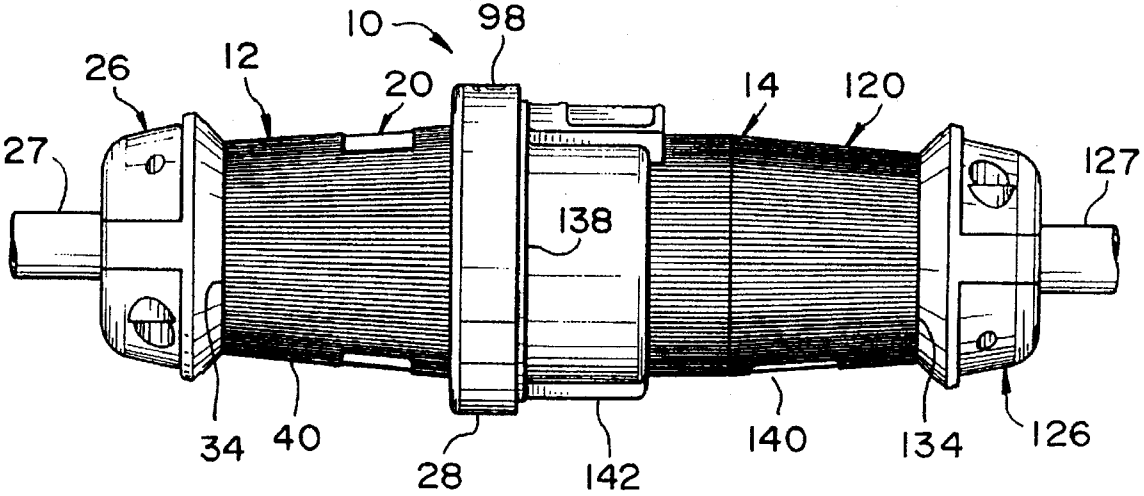
FIG. 3 is a side elevational view of the electrical connectors illustrated in FIGS. 2 and 3 after initial coupling therebetween, but prior to relative rotation therebetween.
Figure 4:
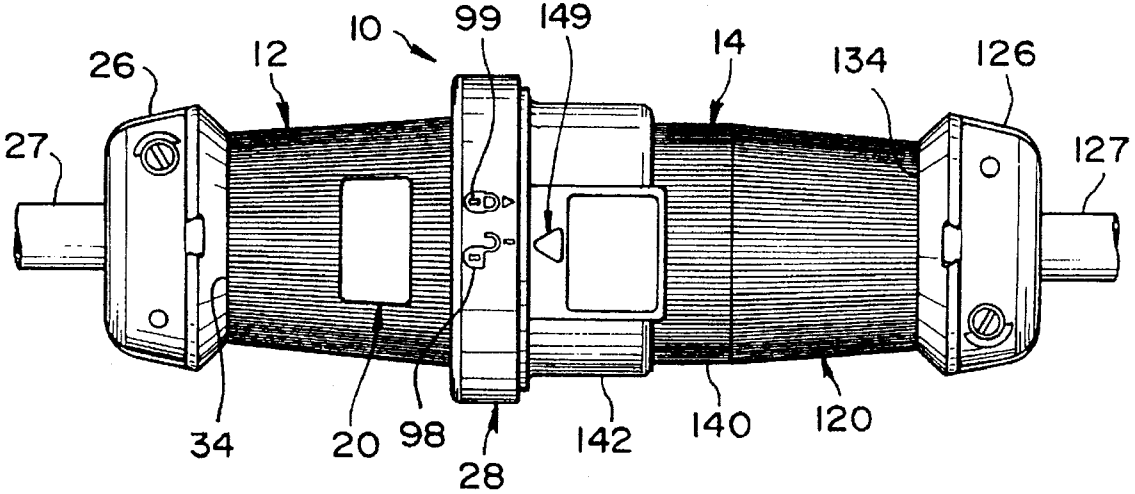
FIG. 4 is a top plan view of the electrical connectors illustrated in FIG. 3 just after initial coupling of the electrical connectors, but prior to relative rotation therebetween.
Figure 5:
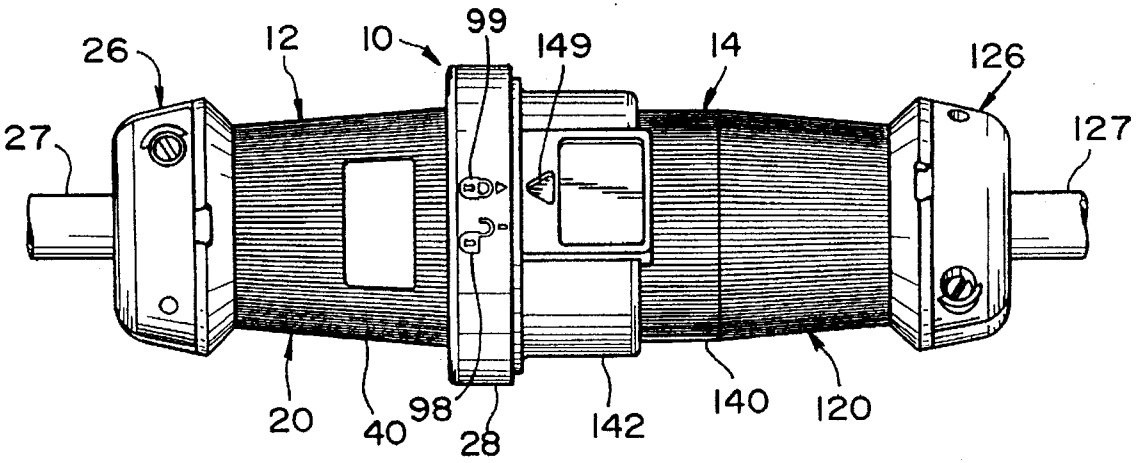
FIG. 5 is a top plan view of the electrical connectors illustrated in FIGS. 1–4 after complete relative rotation therebetween to their locked position.
Figure 7:
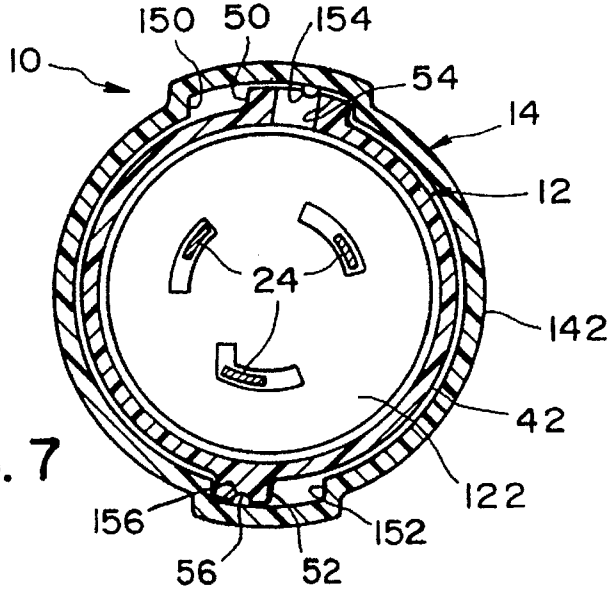
FIG. 7 is a transverse cross-sectional view of the electrical connectors illustrated in FIG. 5 with the contact housing of the female electrical connector shown in elevation.
Figure 6:
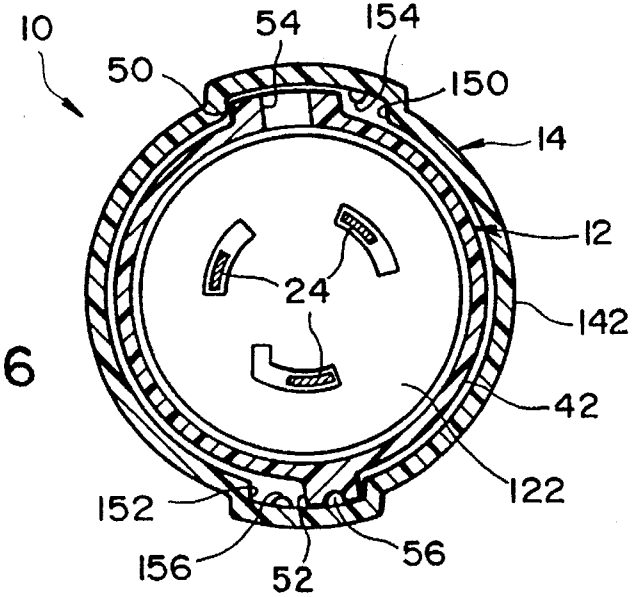
FIG. 6 is a transverse cross-sectional view of the electrical connectors illustrated in FIG. 3 with the contact housing of the female electrical connector shown in elevation.
Figures 8, 9:
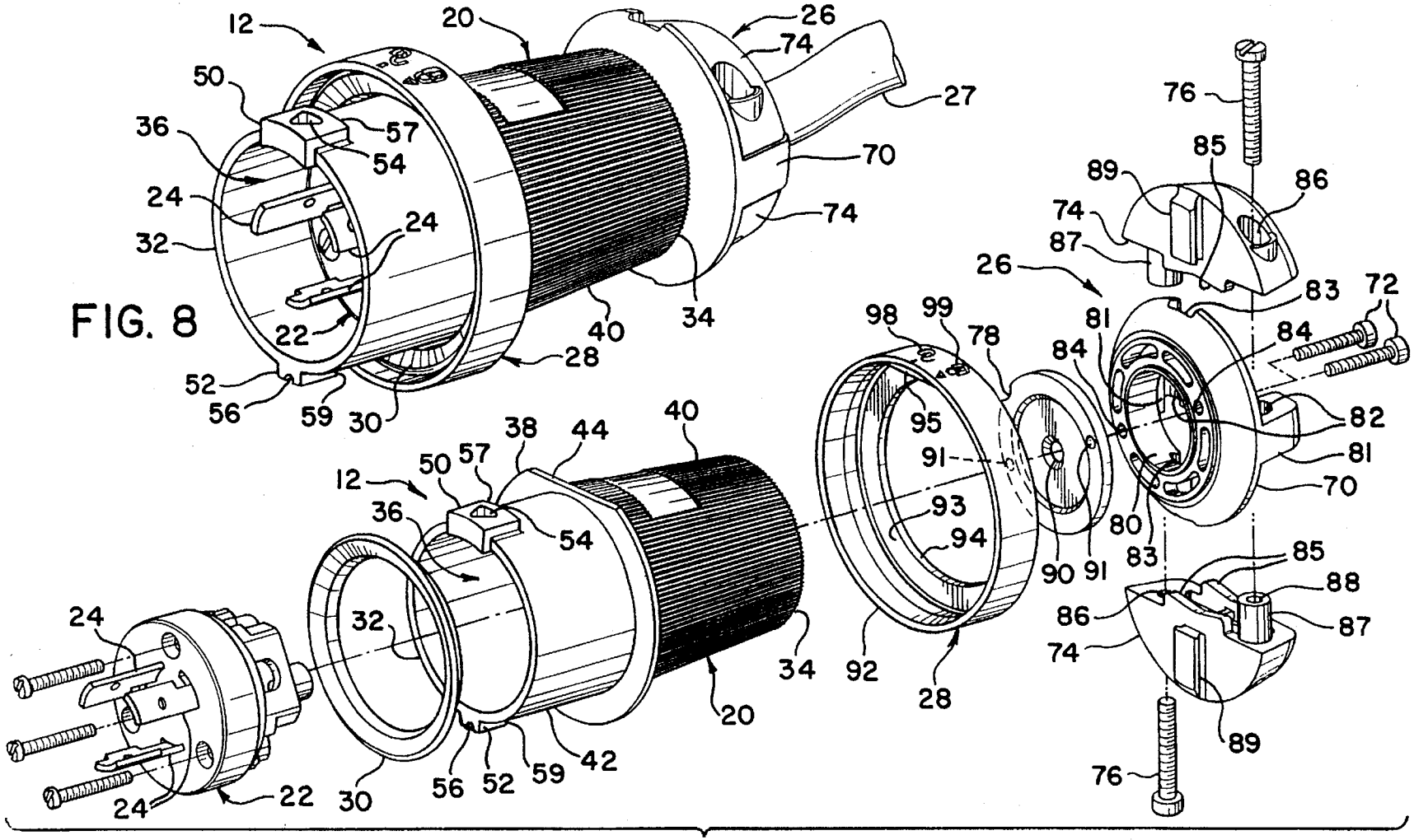
FIG. 8 is a front end perspective view of the male electrical connector illustrated in FIGS. 1–7.
FIG. 9 is an exploded front end perspective view of the male electrical connector illustrated in FIGS. 1–8.

As seen in FIGS. 8 and 9, electrical connector 12 includes an insulated housing 20, a contact retainer housing 22 coupled within housing 20, a set of electrical contacts 24 coupled to contact retainer housing 22, a cord clamp assembly 26 coupled to one end of housing 20 for coupling an electrical cord 27 to housing 20, a seal guard ring 28 coupled to the exterior of housing 20, and a seal or gasket 30 retained within seal guard ring 28.

Referring now to FIGS. 10–14, housing 20 of male electrical connector 12 is a substantially cylindrical member constructed out of any suitable insulating material such as a hard, rigid plastic material. Housing 20 has a first end 32 for mating with electrical connector 14, a second end 34 for attaching cord clamp assembly 26 and electrical cord 27 thereto, and a cylindrical interior passageway 36 extending between ends 32 and 34 for receiving contact retainer housing 22 and a portion of electrical cord 27 therein. The exterior of housing 20 has an annular flange 38 extending outwardly therefrom. Annular flange 38 divides housing 20 into a gripping portion or main body 40 and a coupling portion or safety shroud 42. Annular flange 38 is substantially circular, except for a flat portion 44 for engaging seal guard ring 28. Flat portion 44 engages seal guard ring 28 for ensuring that seal guard ring 28 is properly oriented on housing 20 as discussed below.

Figure 13:
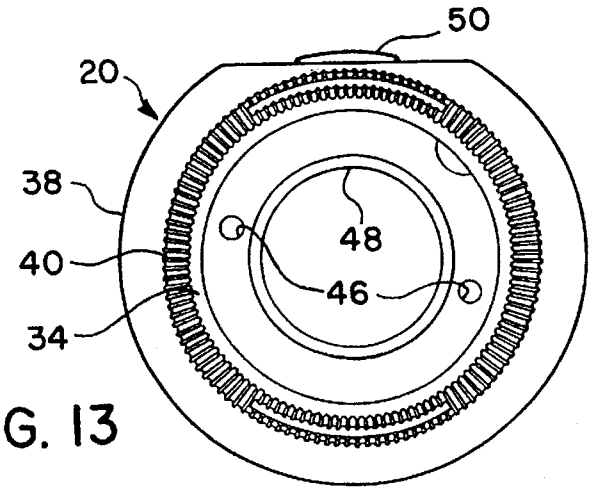
FIG. 13 is a rear end elevational view of the housing for the male electrical connector illustrated in FIGS. 10–12.
Figure 10:
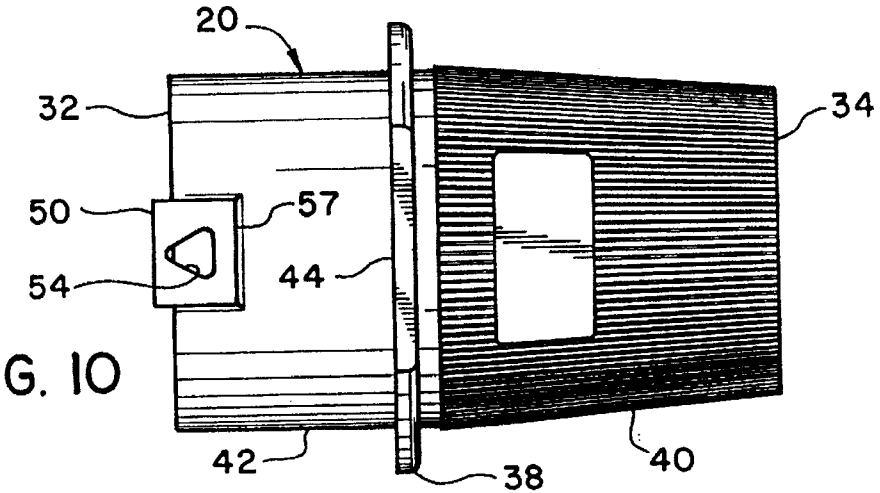
FIG. 10 is a top plan view of the housing for the male electrical connector illustrated in FIGS. 8 and 9.
Figure 11:
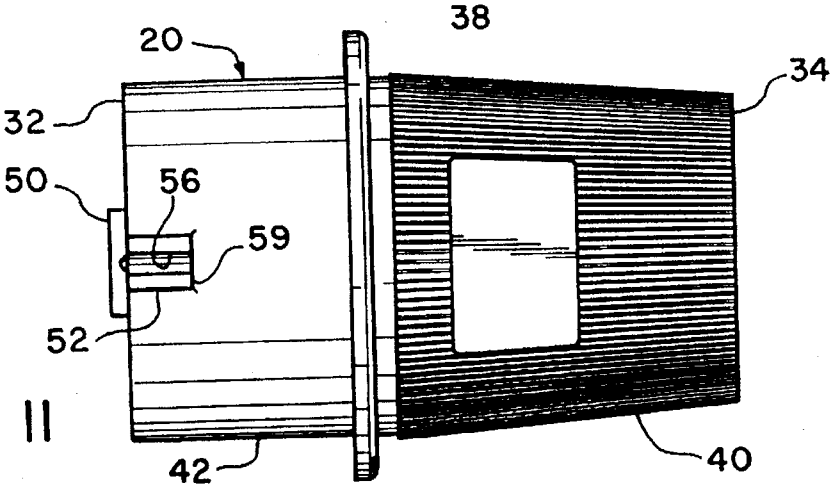
FIG. 11 is a bottom plan view of the housing for the male electrical connector illustrated in FIG. 10.
Figure 15:
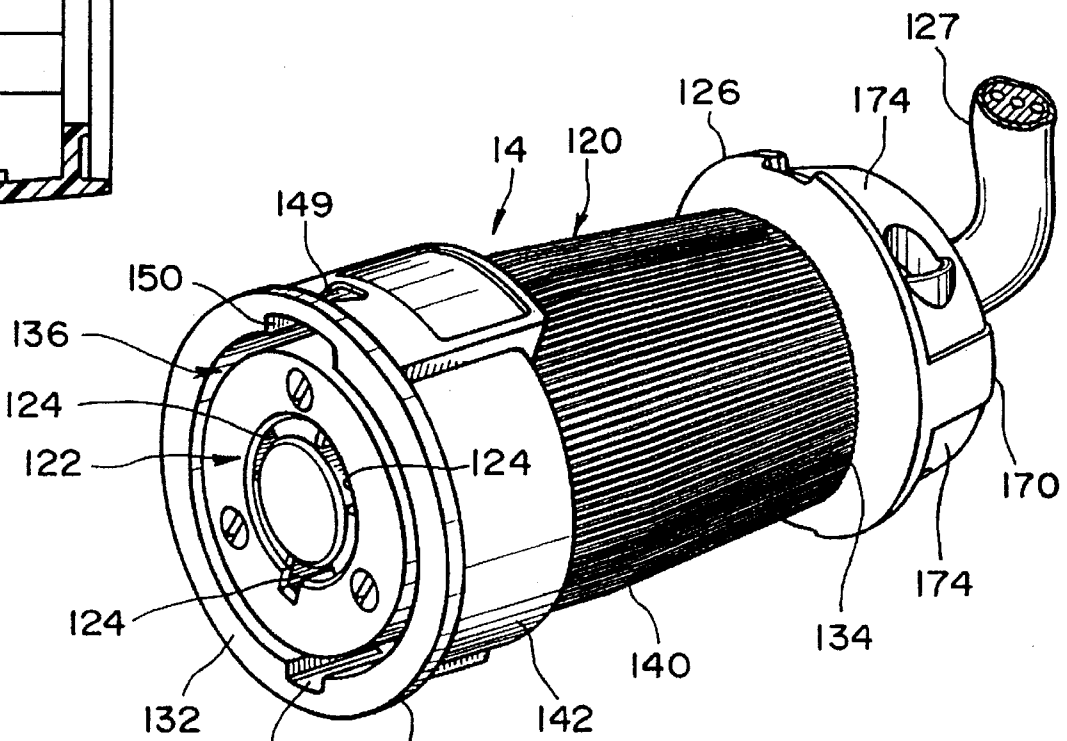
FIG. 15 is a front end perspective view of the female electrical connector illustrated in FIGS. 1–7.

Gripping portion 40 is preferably ribbed to allow the user to grip housing 20 and rotate it during coupling with electrical connector 14. As seen in FIG. 13, gripping portion 40 is adjacent second end 34 of housing 20, which has a pair of fastener holes 46 for securing cord clamp assembly 26 thereto, and a central opening 48 for receiving one end of electrical cord 27 therethrough into housing 20.

Coupling portion or safety shroud 42 forms a sleeve which surrounds contacts 24 so that contacts 24 do not extend out of housing 20, but rather are protected from inadvertent contact. Shroud or sleeve 42 has a pair of polarizing members or keys 50 and 52 formed on its exterior surface adjacent first end 32 of housing 20. Keys 50 and 52 are preferably spaced approximately 180° apart. Keys 50 and 52 are preferably shaped differently so that mating electrical connector 14 can only be coupled thereto in one way. For example, key 50 is wider than key 52.

Key 50 has a triangular shaped recess or detent 54. Detent 54 acts as alignment indicia for indicating correct relative positioning or orientation of electrical connector 12 with electrical connector 14 so that they can be electrically coupled together. Detent 54 also engages a portion of electrical connector 14 for locking electrical connectors 12 and 14 together in their electrically coupled position as discussed below.

Key 52 also has a recess or detent 56 which is formed in the shape of a longitudinally extending groove. Detent 56 also engages a portion of electrical connector 14 for locking electrical connectors 12 and 14 together in their electrically coupled position as discussed below.

Keys 50 and 52 extend outwardly from shroud 42, and each have an abutment surfaces 57 and 59, respectively, for engaging a portion of electrical connector 14 to prevent axial separation when electrical connectors 12 and 14 are electrically coupled together, as discussed below in more detail. Abutment surfaces 57 and 59 face axially towards second end 34 of electrical connector 12.

Figure 12:
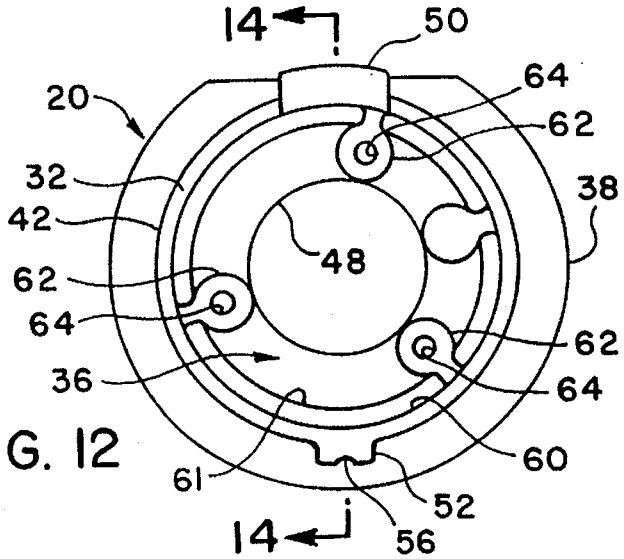
FIG. 12 is a front end elevational view of the housing for the male electrical connector illustrated in FIGS. 10 and 11.
Figure 14:
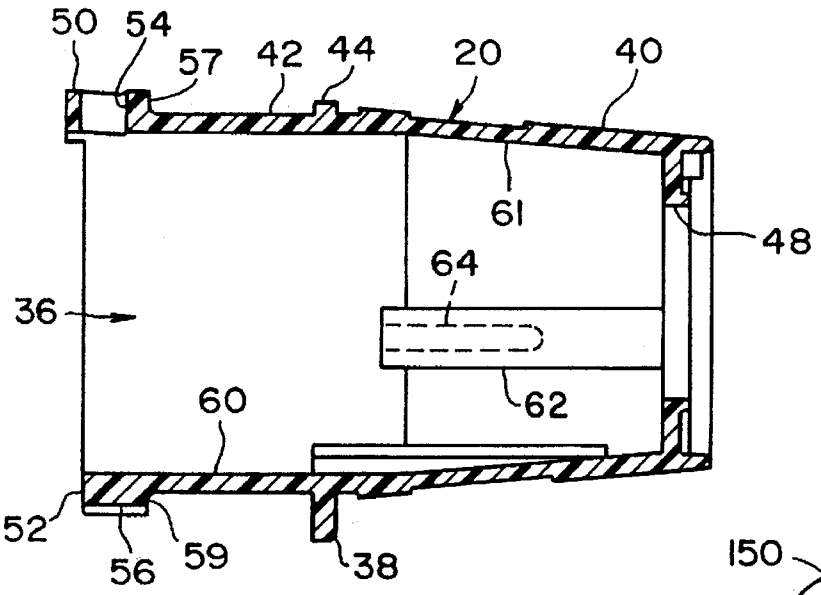
FIG. 14 is a longitudinal cross-sectional view of the housing for the male electrical connector taken along section line 14—14 of FIG. 12.

As seen in FIGS. 12 and 14, passageway 36 of housing 20 is substantially cylindrical with a first cylindrical portion 60 which receives contact retainer housing 22 therein and a second frustoconical portion 61 for receiving the end of electrical cord 27 therein. Second frustoconical portion 61 has three abutment members 62 with fastener holes 64 for rigidly coupling contact retainer housing 22 thereto.

As seen in FIG. 9, contact retainer housing 22 is a conventional contact retainer housing, and thus, will not be discussed or illustrated in detail herein. Contact retainer housing 22 supports electrical contacts 24 in such a manner so that the ends of the wires of electrical cord 27 are electrically coupled to electrical contacts 24 in a conventional manner. In other words, contact retainer housing 22 holds electrical contacts 24 in their correct orientation to mate with the female contacts of electrical connector 14 and to be electrically coupled to the ends of the wires of electrical cord 27.

Since electrical connector 12 is a male electrical connector, electrical contacts 24 are arcuate blade contacts, which are circularly arranged. Contacts 24 are flag shaped blade contacts which are well known in the art. Accordingly, contacts 24 will not be discussed or illustrated in detail herein. Of course, electrical connector 12 can be converted to a female electrical connector by replacing the blade contacts 24 with female contacts, and electrical connector 14 can be converted to a male electrical connector by replacing its contacts with blade contacts.

Contact retainer housing 22 is releasably coupled within housing 20 by three threaded fasteners or screws 66 which are received in fastener openings 64 of housing 20. Fasteners 66 fixedly and rigidly secures contact retainer housing 22 within passageway 36 of housing 20 so that no relative movement occurs therebetween.

As seen in FIGS. 8 and 9, cord clamp assembly 26 includes gland cap 70 releasably coupled to housing 20 by a pair of threaded fasteners or screws 72, a pair of cord grips 74 releasably and movably coupled to gland cap 70 by threaded fasteners or screws 76, and a cord seal 78.

Gland cap 70 is substantially ring-shaped, and includes a central cord opening 80, a pair of arms 81 with first open cylindrical slots 82, a pair of dovetail slots 83, and a pair of fastener bores 84 for threadedly receiving screws 72. Gland cap 70 is preferably a one-piece, unitary member which is integrally formed from a suitable plastic material.

Cord grips 74 are substantially identical, and each include a pair of cord gripping flanges 85, a fastener bore 86, a cylindrical tubular member 87 with a blind bore 88 for threadedly receiving one of the screws 76, and a dovetail rib or mortise 89 for slidably engaging one of the dovetail slots 83. Preferably, cord grips 74 are integrally formed as one-piece, unitary members from a suitable hard, rigid plastic material. Cord grips 74 are movably coupled to gland cap 70 for squeezing and firmly securing cord 27 therebetween. Specifically, screws 76 are tightened to move cord grips 74 radially inwardly so that flanges 85 engage and squeeze cord 27 therebetween.

Cord seal 78 has a central cord opening 90 and a pair of fastener openings 91. Cord seal 78 is constructed of a sealing material such as a rubber or neoprene material such that cord seal 78 forms a watertight seal between cord clamp assembly 26 and housing 20 as well as around cord 27. Specifically, cord seal 78 is positioned between cord clamp assembly 26 and housing 20 such that fasteners 72 are received in fastener openings 91 and cord 27 is received through cord opening 90.

Seal guard ring 28 is substantially circular with a cylindrical outer portion 92, and an annular end portion 93 extending radially inwardly from outer portion 92 to form a circular opening 94. A flat positioning member 95 is formed on the inside surfaces of outer portion 92 and end portion 93 for engaging flat portion 44 of annular flange 38 on housing 20. Preferably, opening 94 is sized to frictionally retain ring 28 on gripping portion 40 of housing 20. Specifically, ring 28 is press-fitted over gripping portion 40 so that end portion 93 engages annular flange 38 of housing 20 with positioning member 95 engaging flat portion 44 of annular flange 38 to maintain the correct orientation therebetween. The outer surface of outer portion 94 includes unlocking indicia 98 and locking indicia 99. Unlocking and locking indicia 98 and 99 are preferably spaced approximately 13.5° to approximately 14° apart to indicate whether electrical connector 12 is in its locked or unlocked position relative to electrical connector 14.

Referring now to FIGS. 15–21, electrical connector 14 includes an insulated housing 120, a contact retainer housing 122 coupled within housing 120, a set of electrical contacts 124 coupled to contact retainer housing 122, and a cord clamp assembly 126 coupled to one end of housing 120 for coupling electrical cord 127 to housing 120.

Referring in particular to FIGS. 17–21, housing 120 of female electrical connector 14 is a substantially cylindrical member constructed out of any suitable insulating material such as a hard, rigid plastic material. Housing 120 has a first end 132 for mating with electrical connector 12, a second end 134 for attaching cord clamp assembly 126 and electrical cord 127 thereto, and a cylindrical interior passageway 136 extending between ends 132 and 134 for receiving contact retainer housing 122 and a portion of electrical cord 127 therein. The exterior of housing 120 has an annular flange 138 extending outwardly therefrom adjacent first end 132. Housing 120 is divided into a gripping portion 140 and a coupling portion 142.

Referring now to FIGS. 17–20, gripping portion 140 is preferably ribbed from coupling portion 142 to second end 134 of housing 120 to allow the user to grip housing 120 and rotate it during coupling with electrical connector 12. The second end 134 of housing 120 has a pair of fastener holes 146 for securing cord clamp assembly 126 thereto, and a central opening 148 for receiving one end of electrical cord 127 therethrough into housing 120.

Coupling portion or safety shroud 142 forms a sleeve which surrounds contact retainer housing 122 and contacts 124 so that contacts 124 do not extend out of housing 120. Shroud or sleeve 142 has a triangular alignment mark 149 formed on its exterior surface adjacent first end 132, and a pair of polarizing members or slots 150 and 152 formed on the interior surface of shroud 142 adjacent first end 132 of housing 120. Alignment mark 149 is positioned such that when alignment mark 149 is aligned with triangular detent 54, the electrical connectors 12 and 14 are correctly positioned for relative axial insertion and subsequent rotation.

Slots 150 and 152 are preferably spaced approximately 180° apart, and have different shapes or widths for accommodating keys 50 and 52 of electrical connector 12. Slots 150 and 152 are preferably L-shaped and each have a protrusion or detent 154 and 156, respectively, formed therein, and form axially facing abutment surfaces 157 and 158 for engaging abutment surfaces 57 and 58 of keys 50 and 52 to prevent axial separation of electrical connectors 12 and 14.

Detents 154 and 156 are preferably small bumps which extend inwardly from shroud 142 for selectively engaging detents or recesses 54 and 56 of electrical connector 12 via a snap-fit. Detent 154 and 156 are preferably spaced approximately 180° apart. However, since detent or recess 54 of electrical connector 12 is triangular, detents 154 and 156 are not exactly 180° apart. For example, detent 154 is spaced slightly greater than 14° from the longitudinal center plane of electrical connector 14, while detent 156 is spaced 14° from the longitudinal center plane of electrical connector 14, while detent 156 is spaced 14° from the longitudinal center plane of electrical connector 14. If detents 154 and 156 were spaced exactly 180° apart, detent 154 would be located in the center of triangular detent or recess 54, and thus, would not provide a positive lock therebetween. Of course, detent 54 can be modified to be identical to detent 56 such that detents 154 and 156 would be spaced exactly 180° apart.

Shroud or sleeve 142 is spaced from contact retainer housing 122 to form an annular, cylindrical passageway 159 for receiving shroud or sleeve 42 of electrical connector 12 therein. Slots 150 and 152 are positioned such that they first extend longitudinally from first end 132 and then turn 90° to extend circumferentially along shroud or sleeve 142.

Accordingly, when electrical connectors 12 and 14 are coupled together, shroud 42 of electrical connector 12 is received with shroud 142 of electrical connector 14 such that keys 50 and 52 can initially move axially along slots 150 and 152 until first end 132 of electrical connector 14 engages and slightly compresses gasket 30 of electrical connector 12. Now, electrical connectors 12 and 14 can be rotated relative to each other about 13.5° to about 14° such that keys 50 and 52 move circumferentially within slots 150 and 152, and detents 54 and 56 engage detents 154 and 156 via a snap-fit. In this position, electrical connectors 12 and 14 cannot be separated by merely applying an axially directed separation force therebetween. Specifically, abutment surfaces 57 and 58 of keys 50 and 52 engage abutment surfaces 157 and 158 of slots 150 and 152 to prevent axially separation of electrical connectors 12 and 14, while detents 54 and 56 of electrical connector 12 engage detents 154 and 156 of electrical connector 14 to prevent inadvertent rotational movement therebetween, until an intentional, manual release rotation is applied therebetween.

Figure 19:
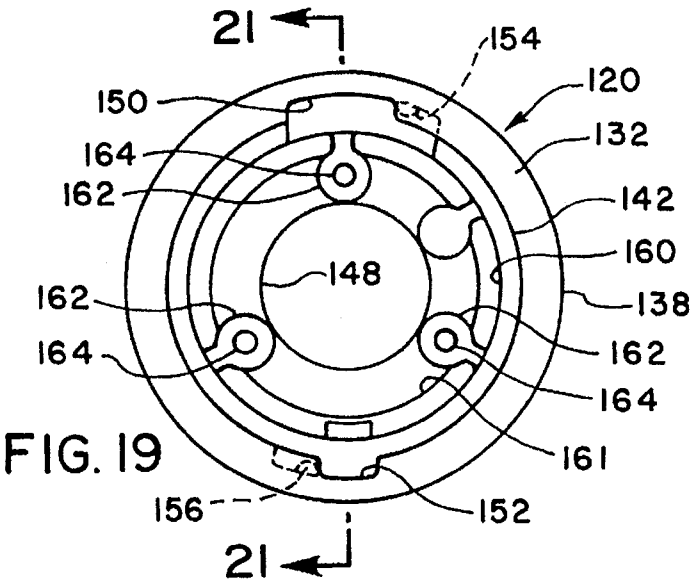
FIG. 19 is a front end elevational view of the female electrical connector illustrated in FIGS. 17 and 18.
Figure 20:
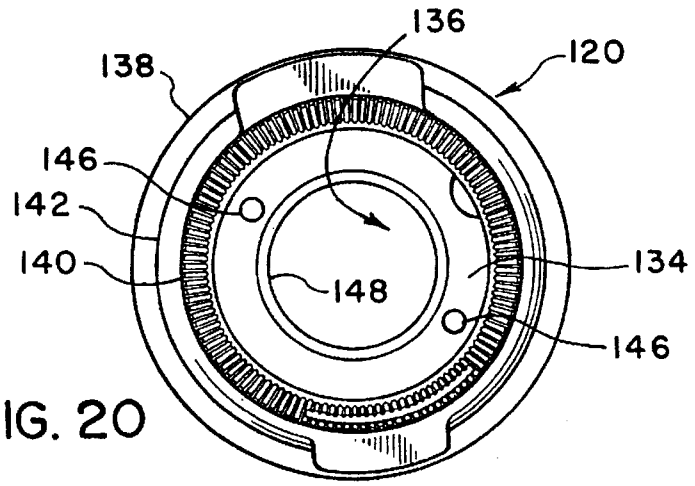
FIG. 20 is a rear end elevational view of the female electrical connector illustrated in FIGS. 17–19.
Figure 17:
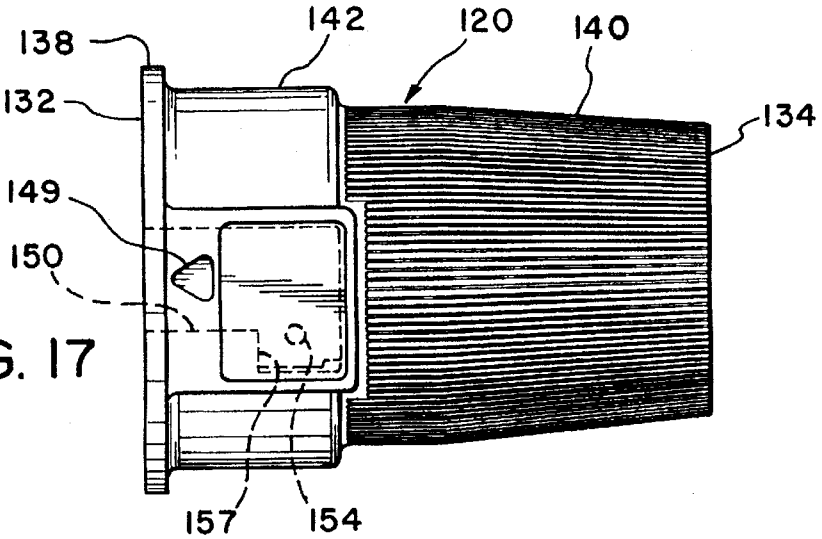
FIG. 17 is a top plan view of the housing for the female electrical connector illustrated in FIGS. 15 and 16.
Figure 18:
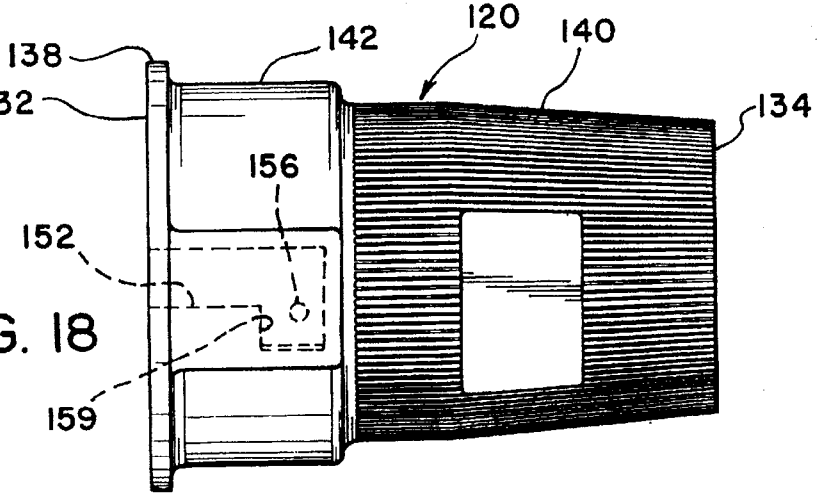
FIG. 18 is a bottom plan view of the housing for the female electrical connector illustrated in FIG. 17.
Figure 21:
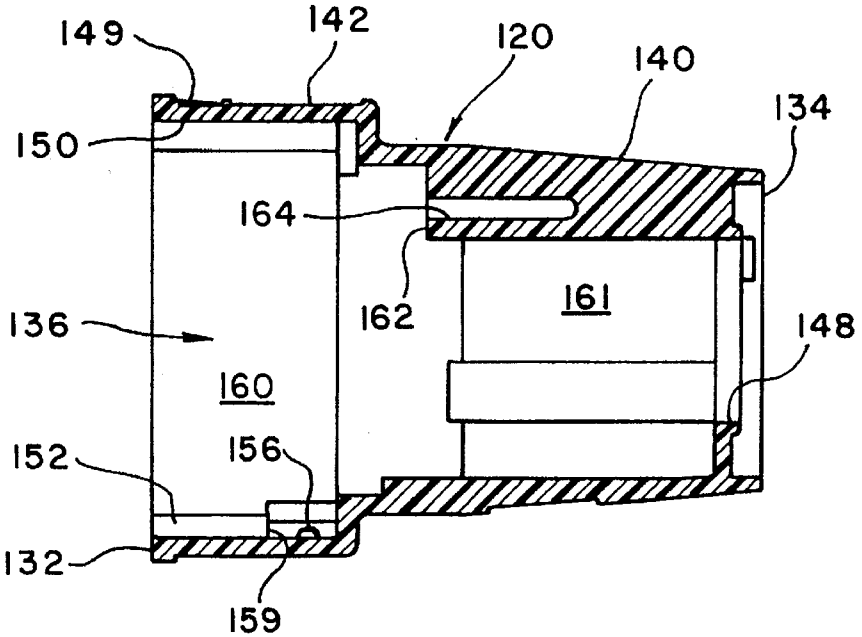
FIG. 21 is a longitudinal cross-sectional view of the housing for the female electrical connector taken along section line 21—21 of FIG. 19.

As seen in FIGS. 19–21, passageway 136 of housing 120 is substantially cylindrical with a first cylindrical portion 160 which receives contact retainer housing 122 therein and a second cylindrical portion 161 for receiving a portion of electrical cord 127 therein. Second cylindrical portion 161 has three abutment members 162 with fastener holes 164 for rigidly coupling contact retainer housing 122 thereto.

Figure 16:
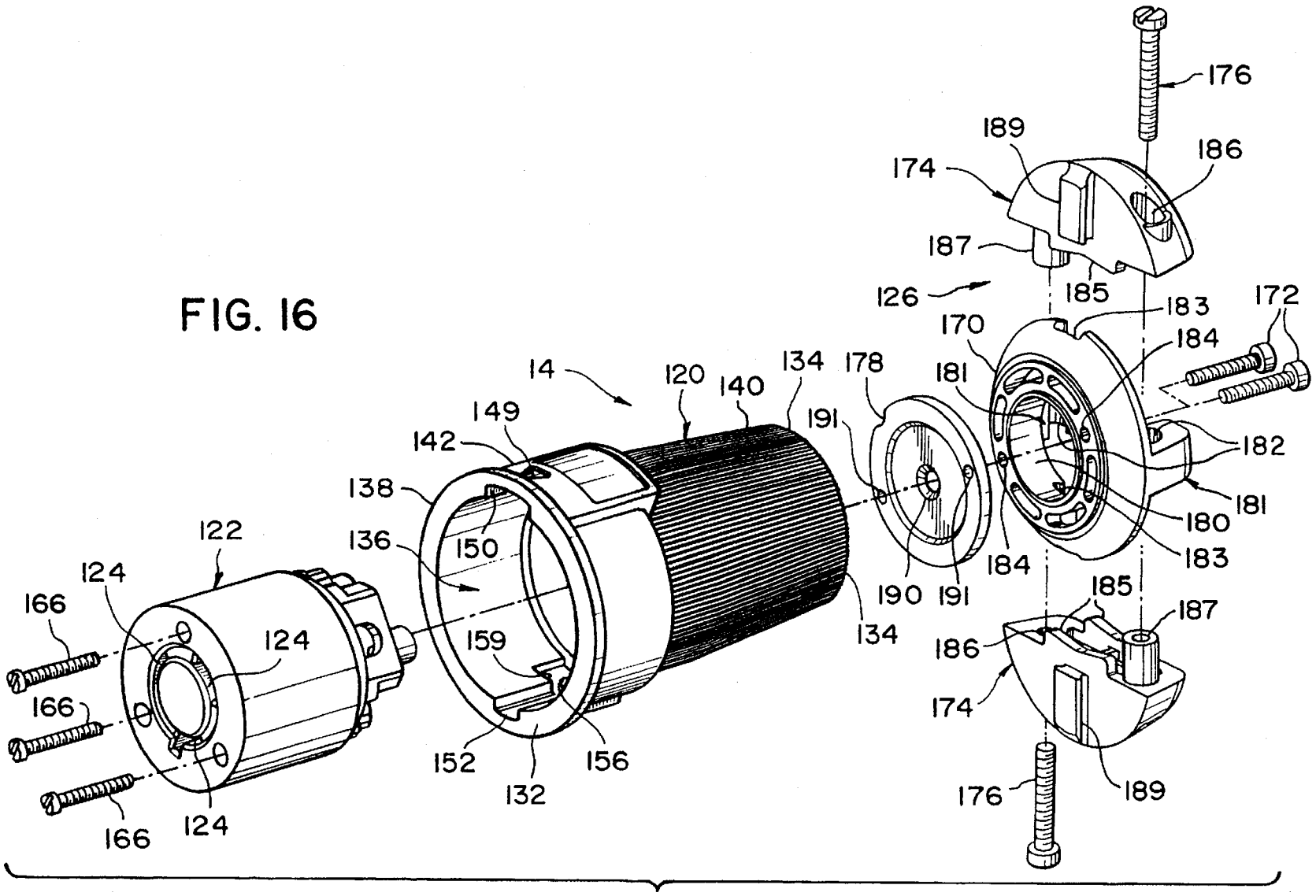
FIG. 16 is an exploded front end perspective view of the female electrical connector illustrated in FIGS. 1–7 and 15.

As seen in FIG. 16, contact retainer housing 122 is a conventional contact retainer housing, and thus, will not be discussed or illustrated in detail herein. Contact retainer housing 22 supports electrical contacts 124 in such a manner so that the ends of the wires of cord 127 can be electrically coupled thereto in a conventional manner, and electrical contacts 24 of electrical connector 12 can be electrically engaged therewith by initial axial movement and subsequent rotational movement between electrical connectors 12 and 14. In other words, contact retainer housing 122 holds its electrical contacts 124 in their correct orientation to receive male electrical contacts 24 of electrical connector 12, and to be electrically coupled to the ends of the wires of cord 127.

Contacts 124 are conventional female contacts, which are circularly arranged for receiving male contacts 24 of electrical connector 12. Since contacts 124 are well known in the art, they will not be illustrated or discussed in detail herein.

Contact retainer housing 122 is releasably coupled within housing 120 by three threaded fasteners or screws 166 which are received in fastener openings 164 of housing 120. Fasteners 166 fixedly and rigidly secures contact retainer housing 122 within passageway 136 of housing 120 so that no relative movement occurs therebetween.

Cord clamp assembly 126 includes gland cap 170 releasably coupled to housing 120 by a pair of threaded fasteners or screws 172, a pair of cord grips 174 releasably and movably coupled to gland cap 170 by threaded fasteners or screws 176, and a cord seal 178.

Gland cap 170 is substantially ring-shaped, and includes a central cord opening 180, a pair of arms 181 with first open cylindrical slots 182, a pair of dovetail slots 183, and a pair of fastener bores 184 for threadedly receiving screws 172. Gland cap 170 is preferably a one-piece, unitary member which is integrally formed from a suitable plastic material.

Cord grips 174 are substantially identical, and each include a pair of cord gripping flanges 185, a fastener bore 186, a cylindrical tubular member 187 with a blind bore 188 for threadedly receiving one of the screws 176, and a dovetail rib or mortise 189 for slidably engaging one of the dovetail slots 183. Preferably, cord grips 174 are integrally formed as one-piece, unitary members from a suitable hard, rigid plastic material. Cord grips 174 are movably coupled to gland cap 170 for squeezing and firmly securing cord 127 therebetween. Specifically, screws 176 are tightened to move cord grips 174 radially inwardly so that flanges 185 engage and squeeze cord 127 therebetween.

Cord seal 178 has a central cord opening 190 and a pair of fastener openings 191. Cord seal 178 is constructed of a sealing material such as a rubber or neoprene material such that cord seal 178 forms a watertight seal between cord clamp assembly 126 and housing 120 as well as around cord 127. Specifically, cord seal 178 is positioned between cord clamp assembly 126 and housing 120 such that fasteners 172 are received in fastener openings 191 and cord 127 is received through cord opening 190.

In use, electrical connector 12 is electrically coupled to electrical connector 14 by first aligning triangular detent 54 of electrical connector 12, which acts as an alignment mark, with alignment mark 149 of electrical connector 14 so that electrical connectors 12 and 14 are correctly positioned for initial relative axial insertion and subsequent rotational movement. In this position, keys 50 and 52 are aligned with slots 150 and 152, respectively, so that shroud 42 of electrical connector 12 can be received within the interior of shroud 142 of electrical connector 14. After initial axial movement between electrical connectors 12 and 14, first end 132 of electrical connector 14 engages and slightly compresses gasket 30 of electrical connector 12 to limit relative axial movement and provide a weather tight seal therebetween.

Now, electrical connectors 12 and 14 can be rotated relative to each other about 13.5° to about 14° such that keys 50 and 52 move circumferentially within slots 150 and 152 of electrical connector 14. Once electrical connectors 12 and 14 have been rotated, electrical connectors 12 and 14 cannot be separated by merely applying an axially directed separation force therebetween because abutment surfaces 57 and 58 of keys 50 and 52 engage abutment surfaces 157 and 158 of slots 150 and 152 to prevent axial separation of electrical connectors 12 and 14. Also, in this position, detents for recesses 54 and 56 of electrical connector 12 engage detents or bumps 154 and 156 of electrical connector 14 to prevent inadvertent rotational movement therebetween, until an intentional, manual release rotation is applied therebetween. Accordingly, electrical connectors 12 and 14 are temporarily locked together to prevent inadvertent separation therebetween.

EMBODIMENT OF FIGS. 22 AND 23

Figure 22:
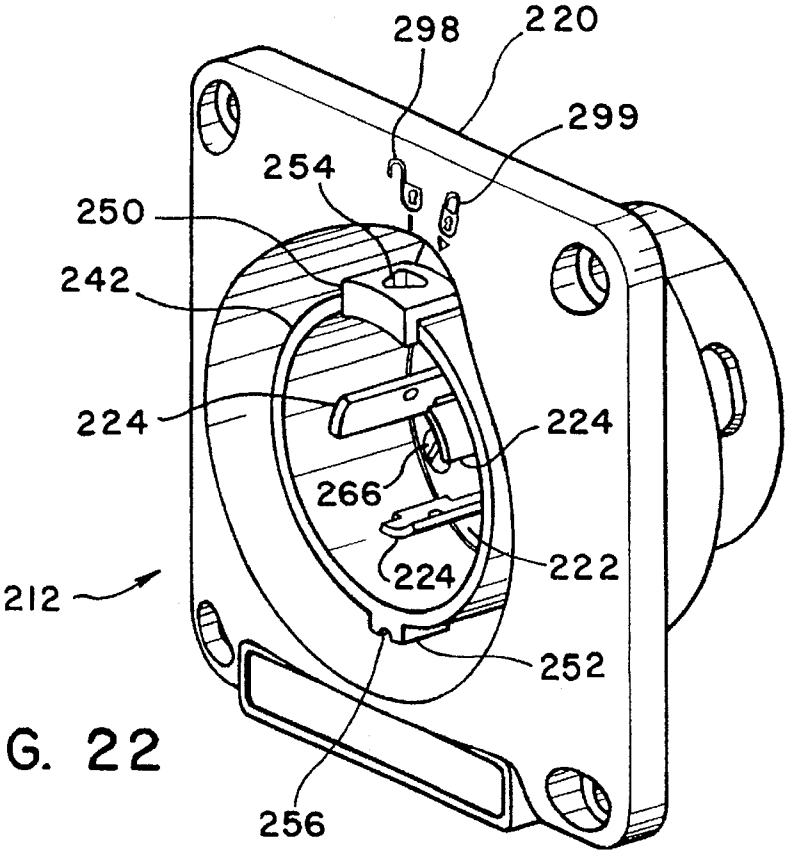
FIG. 22 is a front end perspective view of an alternate version of an electrical connector in accordance with a second embodiment of the present invention, which is adapted to mate with the female electrical connector of FIGS. 1–14.
Figure 23:
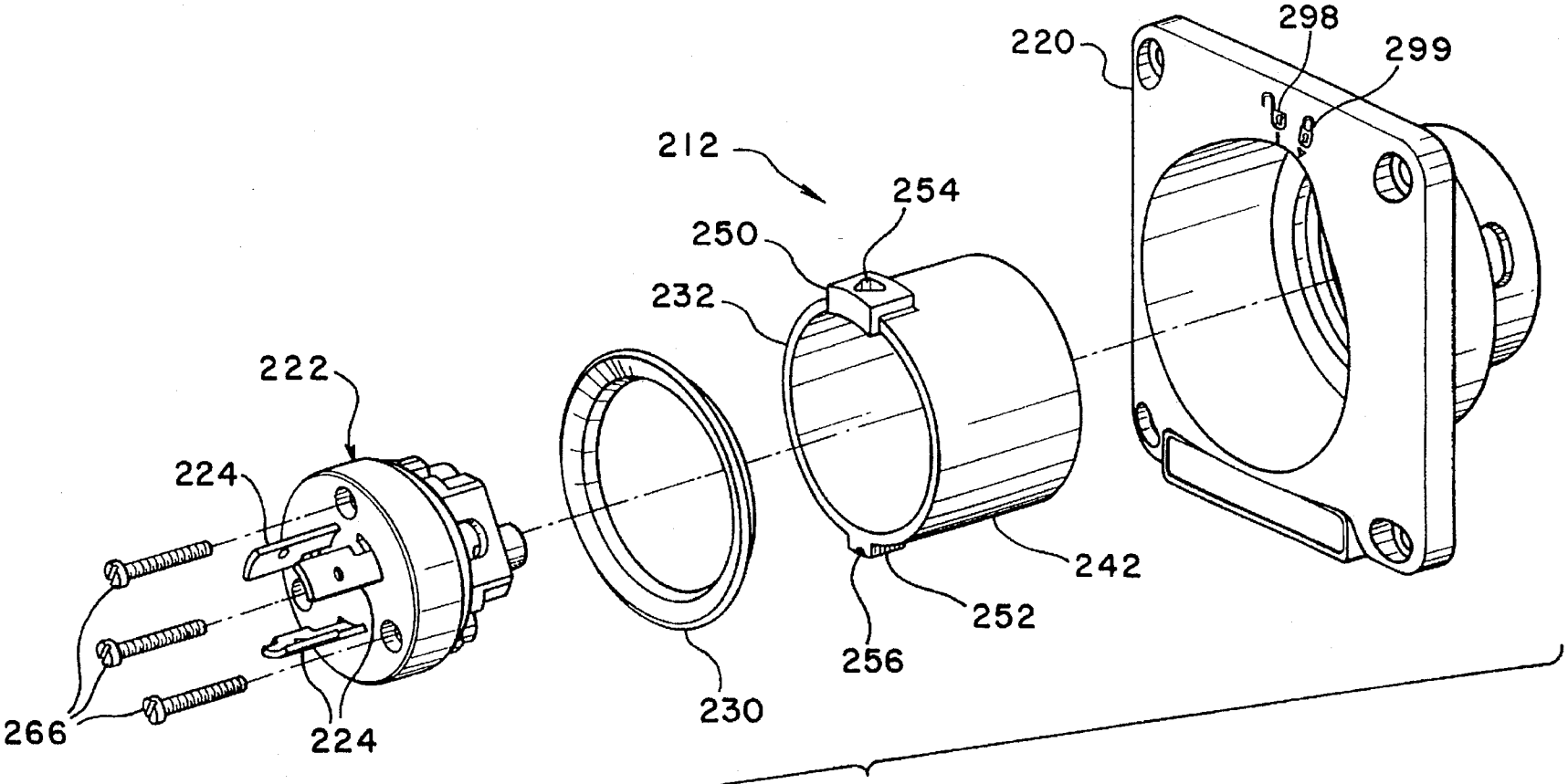
FIG. 23 is an exploded front end perspective view of the male electrical connector of the second embodiment illustrated in FIG. 22.

Referring now to FIGS. 22 and 23, a male electrical connector or inlet 212 in accordance with the present invention is illustrated for use with female electrical connector 14. Basically, electrical connector 212 includes an insulated housing 220, a contact retainer housing 222 coupled within housing 220 by three screws or fasteners 266, a set of male electrical contacts 224 coupled within contact retainer housing 222 in a conventional manner, and a seal or gasket 230 retained within housing 220. Basically, electrical connector 212 of this embodiment is substantially identical to electrical connector 12, except that the electrical connector of this embodiment has been modified to be used in an inlet assembly. Accordingly, electrical connector 212 will not be discussed or illustrated in detail herein.

As seen in FIGS. 22 and 23, housing 220 has a safety shroud or sleeve 242 with a pair of polarizing members or keys 250 and 252 formed on its exterior surface adjacent its first end 232. Preferably, keys 250 and 252 are spaced approximately 180° apart and have recesses or detents 254 and 256, respectively, formed therein. Detent 254 is triangular and acts as alignment indicia for indicating correct relative positioning or orientation of electrical connector 212 with electrical connector 14 so that they can be electrically coupled together. Detent 254 also engages detent 154 of electrical connector 14 for locking electrical connector 14 to electrical connector 212 in substantially the same manner as discussed above pertaining to electrical connector 12.

Recess or detent 256 of key 252 is formed in the shape of a longitudinally extending groove. Detent 256 engages detent 156 of electrical connector 14 for locking electrical connector 14 to electrical connector 212 in substantially the same manner as electrical connectors 12 and 14 are coupled together as discussed above.

Housing 220 of electrical connector 212 has locking and unlocking indicia 298 and 299 on its exterior face for indicating the locked and unlocked position. Accordingly, housing 220 performs the function of seal guard ring 28 of electrical connector 12.

It will be apparent to those skilled in the art from this disclosure that inlet or electrical connector 212 could be modified to be a receptacle or a female electrical connector by changing housing 220 and contact retainer housing 222. Accordingly, the subject invention can be applied to receptacles mounted in electrical enclosures.

While only two embodiments have been chosen to illustrate the invention, it will be understood by those skilled in the art that various changes and modifications can be made herein without departing from the scope of the invention as defined in the appended claims.

What is claimed is:

1. A rotatable locking type electrical connector, comprising:

an insulated housing having a sleeve extending therefrom for nesting with a portion of a mating locking type electrical connector, said sleeve having an interior surface and an exterior surface;

a set of electrical contacts coupled to said housing for electrically engaging electrical contacts of the mating locking type electrical connector;

a first polarizing member positioned on said sleeve for coupling with the mating locking type electrical connector having a complementary polarizing member and for preventing relative axial separation of said housing with the mating locking type electrical connector after relative axial insertion and subsequent rotation of said housing with the mating locking type electrical connector; and a first locking detent positioned on said sleeve in a position to engage a complementary detent of the mating locking type electrical connector after relative axial insertion and subsequent rotation of said housing with the mating locking type electrical connector for holding said housing, said set of electrical contacts and said first polarizing member from relative rotational movement relative to the mating locking type electrical connector, said locking detent being adapted to engage the complementary detent by a snap-fit and to be overridably engageable with the complementary detent by applying an intentional, manual release rotation between said housing and the mating locking type electrical connector.

2. A rotatable locking type electrical connector according to claim 1, wherein said first polarizing member is a first key extending from said sleeve.

3. A rotatable locking type electrical connector according to claim 2, wherein said first key extends outwardly from said sleeve.

4. A rotatable locking type electrical connector according to claim 3, wherein said first locking detent forms alignment indicia for indicating correct relative positioning of said sleeve for coupling with the mating locking type electrical connector when aligned with complementary indicia on the mating locking type electrical connector.

5. A rotatable locking type electrical connector according to claim 3, wherein said first locking detent is formed on said first key.

6. A rotatable locking type electrical connector according to claim 2, further including a second polarizing member positioned on said sleeve.

7. A rotatable locking type electrical connector according to claim 6, wherein said second polarizing member is a second key extending from said sleeve.

8. A rotatable locking type electrical connector according to claim 7, wherein said first detent is formed on said first key.

9. A rotatable locking type electrical connector according to claim 8, wherein said first and second keys extend outwardly from said sleeve.

10. A rotatable locking type electrical connector according to claim 9, wherein said first and second keys are positioned approximately 180° apart.

11. A rotatable locking type electrical connector according to claim 10, wherein said first locking detent forms alignment indicia for indicating correct relative positioning of said sleeve for coupling with the mating locking type electrical connector when aligned with complementary indicia on the mating locking type electrical connector.

12. A rotatable locking type electrical connector according to claim 1, wherein said first polarizing member is a first L-shaped slot adapted to receive the complementary polarizing member.

13. A rotatable locking type electrical connector according to claim 12, wherein said first L-shaped slot is formed on said interior surface of said sleeve.

14. A rotatable locking type electrical connector according to claim 13, wherein said first locking detent is formed on said interior surface of said sleeve within said first L-shaped slot.

15. A rotatable locking type electrical connector according to claim 14, wherein said sleeve has a second polarizing member.

16. A rotatable locking type electrical connector according to claim 15, wherein said second polarizing member is a second L-shaped slot adapted to receive a complementary polarizing member.

17. A rotatable locking type electrical connector according to claim 16, wherein said sleeve has a second locking detent formed on said interior surface within said second L-shaped slot.

18. A rotatable locking type electrical connector according to claim 17, wherein said first and second locking detents are spaced approximately 180° apart.

19. A rotatable locking type electrical connector, comprising:

an insulated housing having a sleeve extending therefrom for nesting with a portion of a mating locking type electrical connector, said sleeve having an interior surface and an exterior surface;

a set of electrical contacts coupled to said housing for electrically engaging electrical contacts of the mating locking type electrical connector;

a first polarizing member positioned on said sleeve, for coupling with the mating locking type electrical connector having a complementary polarizing member; and a first locking detent positioned on said sleeve in a position to engage a complementary detent of the mating locking type electrical connector after relative axial insertion and subsequent rotation of said housing with the mating locking type electrical connector for holding said housing, said set of electrical contacts and said first polarizing member from relative rotational movement relative to the mating locking type electrical connector, said locking detent being overridably engageable with the complementary detent by applying an intentional, manual release rotation between said housing and the mating locking type electrical connector, said first polarizing member being a first key extending outwardly from said sleeve, and said first locking detent being a recess for receiving the complementary detent of the mating locking type electrical connector therein.

20. A rotatable locking type electrical connector according to claim 19, wherein said recess is shaped as an alignment mark for indicating correct relative positioning of said sleeve for coupling with the mating locking type electrical connector when aligned with a complementary mark on the mating locking type electrical connector.

21. A rotatable locking type electrical connector according to claim 20, wherein said recess is substantially triangular in shape.

22. A rotatable locking type electrical connector, comprising:

an insulated housing having a sleeve extending therefrom for nesting with a portion of a mating locking type electrical connector, said sleeve having an interior surface and an exterior surface;

a set of electrical contacts coupled to said housing for electrically engaging electrical contacts of the mating locking type electrical connector;

a first polarizing member positioned on said sleeve, for coupling with the mating locking type electrical connector having a complementary polarizing member; and a first locking detent positioned on said sleeve in a position to engage a complementary detent of the mating locking type electrical connector after relative axial insertion and subsequent rotation of said housing with the mating locking type electrical connector for holding said housing, said set of electrical contacts and said first polarizing member from relative rotational movement relative to the mating locking type electrical connector, said locking detent being overridably engageable with the complementary detent by applying an intentional, manual release rotation between said housing and the mating locking type electrical connector, said first polarizing member being a first key extending from said sleeve, a second polarizing member positioned on said sleeve, and said second polarizing member being a second key extending from said sleeve, said first and second keys extending outwardly from said sleeve and positioned approximately 180° apart, said first locking detent being formed on said first key and being a recess for receiving the complementary detent of the mating locking type electrical connector therein.

23. A rotatable locking type electrical connector according to claim 22, wherein said recess is shaped as an alignment mark for indicating correct relative positioning of said sleeve for coupling with the mating locking type electrical connector when aligned with a complementary mark on the mating locking type electrical connector.

24. A rotatable locking type electrical connector according to claim 23, wherein said set of electrical contacts are arcuate blades which are circularly arranged and extend axially within said sleeve.

25. A rotatable locking type electrical connector according to claim 23, wherein said housing further includes unlocked indicating indicia located adjacent said sleeve at a first position and locked indicting indicia located adjacent said sleeve at a second position spaced from said first position about the circumference of said housing.

26. A rotatable locking type electrical connector according to claim 25, wherein said housing includes a ring coupled thereto adjacent said sleeve with said locked and unlocked indicating indicia thereon.

27. A rotatable locking type electrical connector according to claim 26, wherein said ring is frictionally retained in said housing.

28. A rotatable locking type electrical connector according to claim 26, wherein said ring includes an annular gasket positioned to engage a portion of the mating locking type electrical connector which is nested with said sleeve when coupled together.

29. A rotatable locking type electrical connector assembly, comprising:

a first rotatable locking type electrical connector including
- a first insulated housing,
- a first set of electrical contacts coupled to said first housing,
- a first rotatable polarizing sleeve extending from said first housing, and
- a first locking detent positioned on said first polarizing sleeve; and a second rotatable locking type electrical connector releasably engageable with said first electrical connector, said second electrical connector including
- a second set of electrical contacts coupled to said second housing for electrically engaging said first set of electrical contacts upon relative axial movement and subsequent rotational movement therebetween,
- a second rotatable polarizing sleeve extending from said second housing and being configured to mate with said first polarizing sleeve after relative axial movement and subsequent rotational movement therebetween for preventing relative axial separation between said first polarizing sleeve and said second polarizing sleeve, and
- a second locking detent positioned on said second polarizing sleeve for engaging said first locking detent of said first electrical connector after relative axial movement and relative rotational movement occurs between said first and second polarizing sleeves to hold said first and second polarizing sleeves in a coupled position, said first and second detents configured to engage each other by a snap-fit and to be overridable by applying an intentional, manual release rotation between said first and second housings.

30. A rotatable locking type electrical connector assembly according to claim 29, wherein said first polarizing sleeve includes a first key extending therefrom.

31. A rotatable locking type electrical connector assembly according to claim 30, wherein said first key extends outwardly from said first polarizing sleeve.

32. A rotatable locking type electrical connector assembly according to claim 31, wherein said first locking detent forms a alignment indicia and said second electrical connector having complementary indicia to correctly align said first and second locking type electrical connector for coupling together.

33. A rotatable locking type electrical connector assembly according to claim 31, wherein said first locking detent is formed on said first key.

34. A rotatable locking type electrical connector assembly according to claim 30, further including said first polarizing sleeve includes a second key extending therefrom.

35. A rotatable locking type electrical connector assembly according to claim 34, wherein said first locking detent is formed on said first key.

36. A rotatable locking type electrical connector assembly according to claim 35, wherein said first and second keys extend outwardly from said sleeve.

37. A rotatable locking type electrical connector assembly according to claim 36, wherein said first and second keys are positioned on said sleeve approximately 180° apart.

38. A rotatable locking type electrical connector assembly according to claim 37, wherein said first locking detent forms alignment indicia and said second locking type electrical connector has complementary indicia to correctly align said first and second locking type electrical connector for coupling together.

39. A rotatable locking type electrical connector assembly according to claim 30, wherein said second polarizing sleeve includes a first L-shaped slot adapted to receive said first key.

40. A rotatable locking type electrical connector assembly according to claim 39, wherein said first L-shaped slot is formed on said interior surface of said second sleeve.

41. A rotatable locking type electrical connector assembly according to claim 40, wherein said second locking detent is formed on said interior surface of said sleeve within said first L-shaped slot.

42. A rotatable locking type electrical connector assembly according to claim 41, wherein said second polarizing sleeve includes a second L-shaped slot adapted to receive a second key formed on said first sleeve.

43. A rotatable locking type electrical connector assembly according to claim 42, wherein said second sleeve has a third locking detent formed on said interior surface within said second L-shaped slot.

44. A rotatable locking type electrical connector assembly, comprising:

a first rotatable locking type electrical connector including
- a first insulated housing,
- a first set of electrical contacts coupled to said first housing,
- a first rotatable polarizing sleeve extending from said first housing, and
- a first locking detent positioned on said first polarizing sleeve; and a second rotatable locking type electrical connector releasably engageable with said first electrical connector, said second electrical connector including
- a second set of electrical contacts coupled to said second housing for electrically engaging said first set of electrical contacts upon relative axially movement and subsequent rotational movement therebetween, a second rotatable polarizing sleeve extending from said second housing and being configured to mate with said first polarizing sleeve after relative axial movement and subsequent rotational movement therebetween, and a second locking detent positioned on said second polarizing sleeve for engaging said first locking detent of said first electrical connector after relative axial movement and relative rotational movement occurs between said first and second polarizing sleeves to hold said first and second polarizing sleeves in a coupled position, said first and second detents being configured to be overridable by applying an intentional, manual release rotation between said first and second housings, said first polarizing sleeve including a first key extending outwardly therefrom, said first locking detent being a recess for receiving said second locking detent of said second locking type electrical connector therein.

45. A rotatable locking type electrical connector assembly according to claim 44, wherein said recess is shaped as an alignment mark for indicating correct relative positioning of said first sleeve relative to said second locking type electrical connector when aligned with a complementary mark formed on said second locking type electrical connector.

46. A rotatable locking type electrical connector assembly according to claim 45, wherein said recess is substantially triangular in shape.

47. A rotatable locking type electrical connector assembly, comprising:

a first rotatable locking type electrical connector including a first insulated housing, a first set of electrical contacts coupled to said first housing, a first rotatable polarizing sleeve extending from said first housing, and a first locking detent positioned on said first polarizing sleeve; and a second rotatable locking type electrical connector releasably engageable with said first electrical connector, said second electrical connector including second set of electrical contacts coupled to said second housing for electrically engaging said first set of electrical contacts upon relative axially movement and subsequent rotational movement therebetween, a second rotatable polarizing sleeve extending from said second housing and being configured to mate with said first polarizing sleeve after relative axial movement and subsequent rotational movement therebetween, and a second locking detent positioned on said second polarizing sleeve for engaging said first locking detent of said first electrical connector after relative axial movement and relative rotational movement occurs between said first and second polarizing sleeves to hold said first and second polarizing sleeves in a coupled position, said first and second detents being configured to be overridable by applying an intentional, manual release rotation between said first and second housings, said first polarizing sleeve including first and second keys extending outwardly from said sleeve, said first and second keys being positioned on said sleeve approximately 180° apart, said first locking detent being formed on said first key, and said first locking detent being a recess for receiving said second locking detent of said second locking type electrical connector therein.

48. A rotatable locking type electrical connector assembly according to claim 47, wherein said recess is shaped as an alignment mark for indicating correct relative positioning of said first sleeve relative to said second locking type electrical connector when aligned with a complementary mark formed on said second locking type electrical connector.

49. A rotatable locking type electrical connector assembly according to claim 48, wherein said first set of electrical contacts are arcuate blades which are circularly arranged and extend axially within said sleeve.

50. A rotatable locking type electrical connector assembly according to claim 48, wherein said first housing further includes unlocked indicating indicia located adjacent said first sleeve at a first position and locked indicating indicia located adjacent said first sleeve at a second position spaced from said first position about the circumference of said first housing.

51. A rotatable locking type electrical connector assembly according to claim 50, wherein said first housing includes a ring coupled thereto adjacent said first sleeve with said locked and unlocked indicating indicia thereon.

52. A rotatable locking type electrical connector assembly according to claim 51, wherein said ring includes an annular gasket positioned to engage a portion of said second locking type electrical connector.

53. A rotatable locking type electrical connector, comprising:

an insulated housing having a non-rotatably coupled sleeve extending therefrom for nesting with a portion of a mating locking type electrical connector, said sleeve having an interior surface and an exterior surface;

a set of electrical contacts coupled to said housing for electrically engaging electrical contacts of the mating locking type electrical connector;

a first polarizing member positioned on said interior surface of said sleeve, for coupling with the mating locking type electrical connector having a complementary polarizing member; and a first locking detent formed on said interior surface of said sleeve within said first polarizing member positioned to engage a complementary detent of the mating locking type electrical connector after relative axial insertion and subsequent rotation of said housing with the mating locking type electrical connector for holding said housing, said set of electrical contacts and said first polarizing member from relative rotational movement relative to the mating locking type electrical connector, said locking detent being overridably engageable with the complementary detent by applying an intentional, manual release rotation between said housing and the mating locking type electrical connector.

54. A rotatable locking type electrical connector assembly, comprising:

a first rotatable locking type electrical connector including a first insulated housing, a first set of electrical contacts coupled to said first housing, a first polarizing sleeve extending from said first housing, and a first locking detent positioned on said first polarizing sleeve; and a second rotatable locking type electrical connector releasably engageable with said first electrical connector, said second electrical connector including a second set of electrical contacts coupled to said second housing for electrically engaging said first set of electrical contacts upon relative axially movement and subsequent rotational movement therebetween, a second polarizing sleeve non-rotatably coupled to and extending from said second housing and being configured to mate with said first polarizing sleeve after relative axial movement and subsequent rotational movement therebetween, said second polarizing sleeve having an interior surface and an exterior surface, and a second locking detent formed on said interior surface of said second polarizing sleeve within said second polarizing member for engaging said first locking detent of said first electrical connector after relative axial movement and relative rotational movement occurs between said first and second polarizing sleeves to hold said first and second polarizing sleeves in a coupled position, said first and second detents configured to be overridable by applying an intentional, manual release rotation between said first and second housings.

55. A rotatable locking type electrical connector, comprising an insulated housing having a sleeve extending therefrom for nesting with a portion of a mating locking type electrical connector, said sleeve having an interior surface and an exterior surface; said insulated housing further having a longitudinal axis;

a set of electrical contacts coupled to said housing for electrically engaging electrical contacts of the mating locking type electrical connector;

a first polarizing member positioned on said sleeve for coupling with the mating locking type electrical connector having a complementary polarizing member and for preventing relative axial separation of said housing with the mating locking type electrical connector after relative axial insertion and subsequent rotation of said housing with the mating locking type electrical connector; and a first locking detent positioned on said sleeve in a position to engage a complementary detent of the mating locking type electrical connector after relative insertion in the direction of said longitudinal axis and subsequent rotation of said housing with the mating locking type electrical connector for holding said housing, said set of electrical contacts and said first polarizing member from relative rotational movement relative to the mating locking type electrical connector, said locking detent being adapted to engage the complementary detent by overlapping the complementary detent in a direction that is perpendicular to said longitudinal axis, said locking detent being overridably engageable with the complementary detent by applying an intentional, manual release rotation between said housing and the mating locking type electrical connector.

56. A rotatable locking type electrical connector assembly, comprising:

a first rotatable locking type electrical connector including a first insulated housing having a longitudinal axis, a first set of electrical contacts coupled to said first housing, a first rotatable polarizing sleeve extending from said first housing, and a first locking detent positioned on said first polarizing sleeve; and a second rotatable locking type electrical connector releasably engageable with said first electrical connector, said second electrical connector including a second set of electrical contacts coupled to said second housing for electrically engaging said first set of electrical contacts upon relative axial movement and subsequent rotational movement therebetween, a second rotatable polarizing sleeve extending from said second housing and being configured to mate with said first polarizing sleeve after relative movement in the direction of said longitudinal axis and subsequent rotational movement therebetween for preventing relative axial separation between said first polarizing sleeve and said second polarizing sleeve, and a second locking detent positioned on said second polarizing sleeve for engaging said first locking detent of said first electrical connector after relative movement in the direction of said longitudinal axis and relative rotational movement occurs between said first and second polarizing sleeves to hold said first and second polarizing sleeves in a coupled position, said first and second detents overlapping each other in a direction that is perpendicular to said longitudinal axis when said first and second detents are in said coupled position, said first and second detents being configured to be overridable by applying an intentional, manual release rotation between said first and second housings.

* * * * *